US006672806B2

(12) United States Patent
Sibilla

(10) Patent No.: US 6,672,806 B2
(45) Date of Patent: Jan. 6, 2004

(54) DEVICE FOR DRILLING AND ANCHORING AND PROCESS FOR PLACING GROUT ANCHORS

(75) Inventor: Vincenzo Sibilla, Forasol (CH)

(73) Assignee: Forasol International SA, Geneva (CH)

( * ) Notice: Subject to any disclaimer, the term of this patent is extended or adjusted under 35 U.S.C. 154(b) by 0 days.

(21) Appl. No.: 10/445,603

(22) Filed: May 27, 2003

(65) Prior Publication Data

US 2003/0194278 A1 Oct. 16, 2003

Related U.S. Application Data

(63) Continuation of application No. 09/721,328, filed on Nov. 22, 2000, now Pat. No. 6,588,986.

(51) Int. Cl.[7] ..... E02D 5/76; E02D 5/54

(52) U.S. Cl. ..... 405/259.5; 405/266

(58) Field of Search ..... 405/244, 258.1, 405/259.1, 266, 267, 269, 233, 240, 242, 243, 259.5

(56) References Cited

U.S. PATENT DOCUMENTS

| | | | | |
|---|---|---|---|---|
| 3,512,366 A | | 5/1970 | Turzillo | |
| 3,815,368 A | | 6/1974 | Turzillo | |
| 3,973,409 A | * | 8/1976 | Asayama | 405/259.5 |
| 4,036,026 A | | 7/1977 | Asayama | |
| 4,253,781 A | | 3/1981 | Fischer et al. | |
| 4,718,791 A | | 1/1988 | Weatherby | |
| 4,761,098 A | | 8/1988 | Lipsker | |
| 5,348,424 A | | 9/1994 | Tateyama et al. | |

FOREIGN PATENT DOCUMENTS

| | | |
|---|---|---|
| CH | 691128 A5 | 4/2001 |
| DE | 3108331 A | 9/1982 |
| DE | 3926787 A | 2/1991 |
| EP | 413676 A | 2/1991 |
| EP | 0638689 A1 | 2/1995 |
| EP | 1087063 A1 | 3/2001 |
| WO | WO 98/58132 | 12/1998 |

* cited by examiner

*Primary Examiner*—Robert E. Pezzuto
*Assistant Examiner*—Alexandra K. Pechhold
(74) *Attorney, Agent, or Firm*—Clifford W. Browning; Woodard, Emhardt, Moriarty, McNett & Henry LLP

(57) ABSTRACT

A drilling and anchoring device comprises a drilling pipe (8), a drilling tool (12) mounted at the end of the pipe, and one or several cables (4) and/or other anchoring reinforcements. The cables and/or other anchoring reinforcements are so attached to the drilling tool that the drilling tool remains in a grout body (7) formed by cement injection in the ground surrounding a drilling hole (6).

5 Claims, 2 Drawing Sheets

DEVICE FOR DRILLING AND ANCHORING AND PROCESS FOR PLACING GROUT ANCHORS

This application is a continuation of prior application Ser. No. 09/721,328 filed Nov. 22, 2000, now U.S. Pat. No. 6,588,886.

BACKGROUND OF THE INVENTION

The present invention concerns an anchoring device and a process for the placement of grout anchors having the purpose of securing the stability of a structure relative to ground, and involving the drilling of a hole to an anchoring zone in the ground, the introduction of cables and/or other anchoring reinforcements into the drilled hole, and the injection of a cement slurry through said drilled hole so as to form a grout body in said anchoring zone.

Conventional processes of this type require several cement injections for formation of the grout body, for example injections with sleeves which must be separated in time, thus usually requiring several days for formation of the grout body. Moreover, the load bearing strength remains limited, particularly in clayey and loamy grounds, notably because of the limited transverse dimensions of the grout body that can be achieved by the known processes and because of the poor control of formation of this body and its composition, which essentially remains injected cement.

The document EP-A-0 413 676 describes a process of the above mentioned type in which a tool is used that comprises a drilling tool portion and exhibits an axial channel which is the extension of an injection channel, while a valve is so arranged at the entrance of said axial channel that the said entrance can be closed off prior to injection of a cement slurry under pressure through the central channel and said axial channel.

The document EP 0 770 734 describes a process in which the drilling is performed by means of a pipe which, at its front end, is fitted with a drilling and injection tool, this pipe forming a cement injection channel and said tool comprising at least two lateral nozzles pointing in opposite directions. The nozzles are part of a drilling tool having an axial channel which is an extension of said injection channel, while a valve is so arranged between the entrance of said axial channel and said nozzles that said entrance can be closed off prior to injection of the cement slurry under pressure. The cement slurry is injected with a pressure higher than about 40 MPa (400 bar) into the surrounding ground through said nozzles in a direction radial to said pipe while the pipe is turned about its own axis and pulled back in a continuous or discontinuous fashion over a certain bond length. The injection is then stopped and the pipe fully withdrawn. Prior to hardening of the cement, said cables and/or other anchoring reinforcements are introduced into the drilled hole and grout body being formed.

SUMMARY OF THE INVENTION

An object of this invention is to provide an improved anchoring device and an improved process for the placement of grout anchors, in particular a device and respective process of the above-mentioned type where the anchorage is further improved and the operation of placement of the grout anchors simplified and accelerated.

Objects of the invention are achieved by a process comprising the step of drilling a hole by means of a column drill comprising a drilling pipe having at its front end an injection tool and a drilling tool coupled to the injection tool, this pipe forming a cement injection channel and said injection tool comprising at least one or several nozzles allowing a cement slurry to be injected under pressure into the surrounding ground in order to form a grout body, said drilling tool being attached to one or several anchor cables or other anchoring reinforcements, wherein the process further comprises the steps of injecting cement slurry into the surrounding ground and around the anchoring reinforcements and drilling tool, and withdrawing the pipe while leaving the drilling tool in the grout body.

The drilling and anchoring device comprises a column with a drilling pipe, a drilling tool mounted at the pipe's end, and one or several cables and/or other anchoring reinforcements, wherein the cables and/or other anchoring reinforcements are so attached to the drilling tool that the drilling tool remains in a grout body formed by cement injection in the ground surrounding a drilling hole.

The injection tool is preferably equipped with two lateral nozzles pointing in opposite directions and at least one terminal nozzle pointing obliquely toward the central axis of the pipe within which run the cables and/or other anchoring reinforcements. The drilling tool comprises a coupling parties which axially separably slips into the axial channel of the pipe.

During the drilling operation, water under pressure is brought through an axial channel to the drilling tool. The axial channel may be constituted by an inner pipe coaxial with the drilling pipe. The inner pipe may be equipped with a valve, in its upper part for instance, in order to control the supply of water under pressure to the drilling tool during the drilling operation and during the operation of withdrawing the column drill after formation of the grout body.

The space between the drilling pipe and the inner pipe may constitute the cement injection channel.

The terminal nozzle subtends an acute angle to the axial direction, of 30° for instance, so that the cement slurry jet issuing from this nozzle applies a force component in the axial direction to the drilling tool. This allows the drilling tool to be separated from the drilling pipe during formation of the grout body. This nozzle also ensures that the cables and/or other anchoring reinforcements be fully immersed into the grout body.

The device and process according to the invention thus provide a very good anchoring with very few operations and great speed.

The invention also prevents problems from arising when anchoring reinforcements are reintroduced into the drilling hole in conventional processes.

Moreover, the density of reinforcements placed into the axial channel of the pipe can be optimized when the anchoring reinforcements are attached to the drilling tool and are inserted in advance into the drilling pipe, that is, prior to the drilling operation.

Attaching the drilling tool to the end of the anchoring reinforcements also improves the retention of these reinforcements in the grout body.

Features, objectives and advantages of the process according to the invention will appear more clearly from the following description provided as an example and illustrated in the appended drawings.

DETAILED DESCRIPTION OF THE INVENTION

Figure 1:
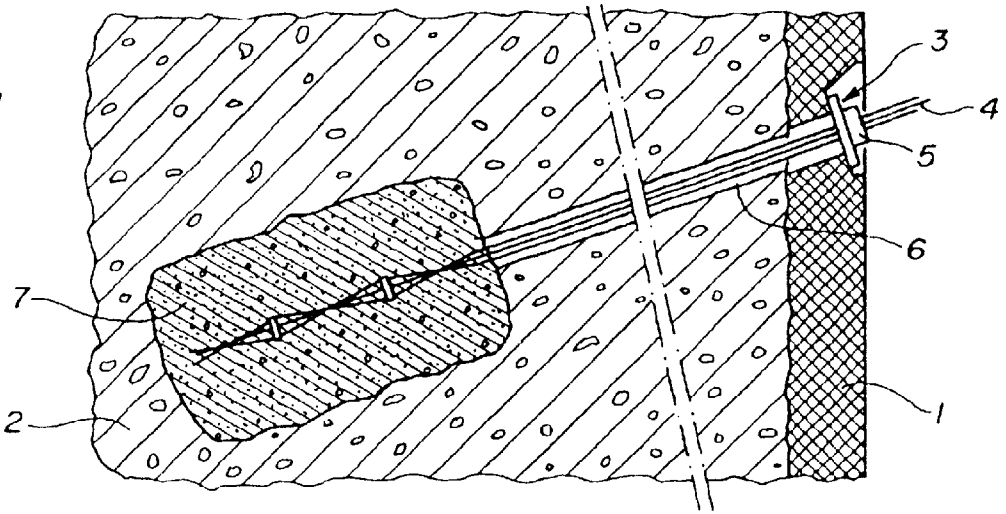
FIG. 1 is a schematic sectional view of a grout anchor placed into a ground.

According to the schematic representation of FIG. 1, a structure to be anchored 1 rests on part of a ground 2 and is stabilized by a grout anchor designated as a whole with the reference numeral 3.

In known manner, this grout anchor for instance comprises anchor cables 4 consisting of strands having one end fixed in an anchor head 5 resting on the structure 1.

The anchor cables 4 are arranged over a certain free length within a drilling hole 6, and are rigidly attached to a bulb-shaped grout body 7 formed around the lower part of the drilling hole by injection of cement under high pressure into the surrounding ground. FIG. 1 only provides a schematic picture of an example of an anchor, as the technology of anchorage as such is well known.

Figure 2:
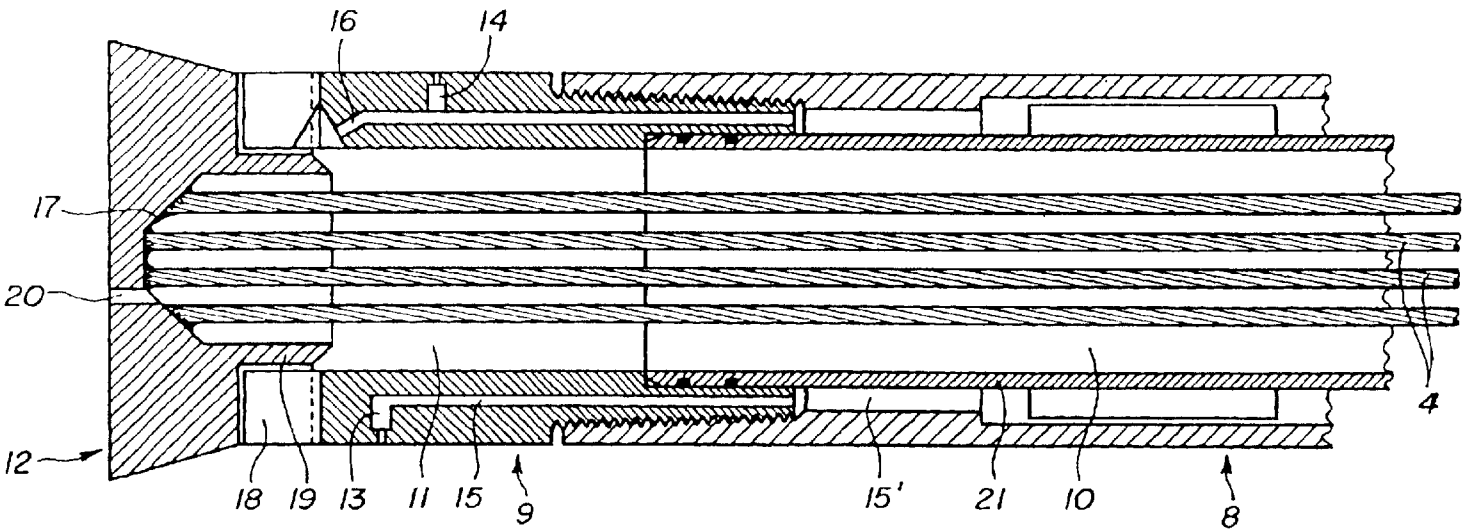
FIG. 2 is a view in axial section of a front end of a drilling and anchoring device.
Figures 3, 4, 5:
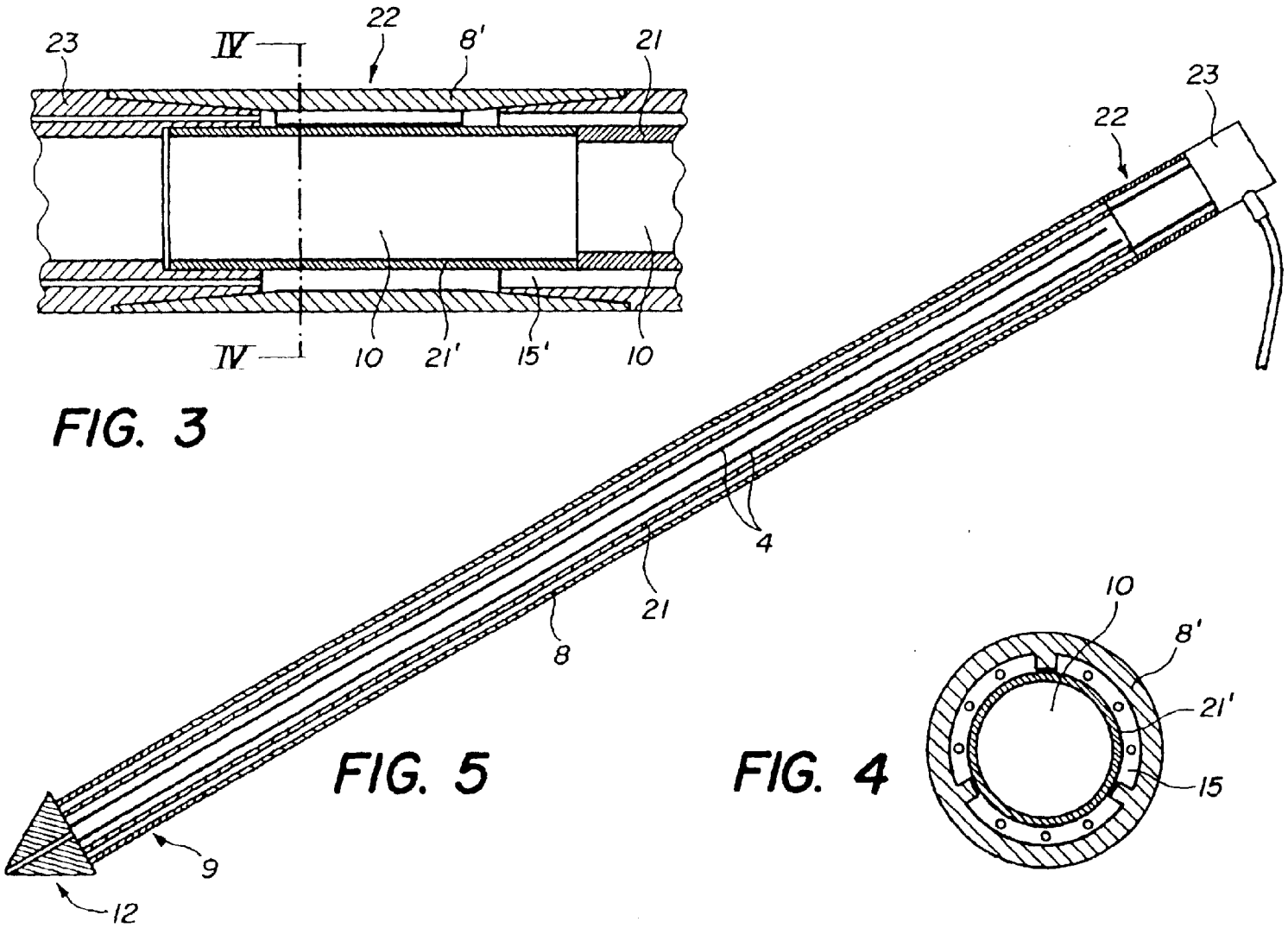
FIG. 3 is a view in axial section of part of a mechanical safety release in a drilling device according to the invention located close to the injection head.
FIG. 4 is a sectional view along the line IV—IV of FIG. 3.
FIG. 5 is a simplified view in axial section of a drilling device according to the invention.

The present invention consists in using, as an example, a column drill with a drilling pipe 8 equipped with an injection tool 9 coupled to a drilling tool 12 according to FIG. 2, with which in a first stage the hole 6 is pierced over a length corresponding to the desired free length and bond length, which essentially is that of the bulb 7 of FIG. 1. The drilling tool 12 is attached to the ends of the amchor cables 4, for instance by welds 17 or by mechanical means of fixation such as keys. Prior to the drilling operation, the drilling tool 12 and the anchor cables 4 are slipped into the central channel 10 of an inner pipe 21 that is coaxial with the drilling pipe 8. The drilling pipe 8 has a length (without partitions) that is at least equivalent to the length of the anchor cables. The drilling tool 12 is coupled in axially separable manner to the injection tool 9 by complementary teeth 18 or other known mechanical means allowing the drilling tool 12 to be rotated by the injection tool 9. The drilling tool 12 preferably comprises a pipe segment 19 slipping into the central channel 10 so as to allow its radial positioning and retention relative to the injection tool 9.

The drilling operation is attended by an injection of water or of a mixture of water and air into the injection tool through the central channel 10 and its extension 11. The water is injected into the drilling hole by one or several channels 20 extending axially through the drilling tool.

When the drilling is finished, a cement slurry is injected into the ground under very high pressure, for instance 450 bar, through one or several inclined terminal nozzles 16 and two or more lateral nozzles 13, 14 of small diameter, viz., 1.5 to 2 mm, which communicate with one or several axial channels 15 in the injection tool 9. The injection channels 15 are linked to an injection channel 15' formed between the walls of drilling pipe 8 and the walls of the inner pipe 21. A valve (not shown) is arranged in the upper part of the drilling pipe in order to close off the central channel 10 during cement injection. During this operation the pipe is rotated around its axis, and slowly withdrawn so that the jets produced by the nozzles 13 and 14 in opposite radial directions penetrate into the ground and yield an essentially cylindrical bulb as shown in FIG. 1.

The injection pressure is preferably between 500 and 800 bars. During injection it may happen that the injection nozzles 13, 14, 16 are clogged by impurities or lumps in the cement which lead to overpressures in the injection channel 15'. The cement injection pump may be equipped with an electric valve in order to disconnect the pump when an overpressure arises. However, during a very abrupt pressure rise the electric valve may not be triggered soon enough to avoid collapse of the inner pipe. To obviate this problem, the column drill is equipped with a mechanical safety release part 22 comprising a part of drilling pipe 8' and a part of inner pipe 21' forming inbetween an injection channel 15'. The mechanical safety release part 22 is located close to the injection head 23, so that a distorted safety release part can readily be exchanged without pulling the column drill from the hole before having finished the operation of cement injection. The part of inner pipe 21' of the safety release part 22 has a smaller wall thickness than the inner pipe 21 of the column drill or another weak section so that the part of the inner pipe 21' collapses more readily than the inner pipe 21. The collapse of the part of inner pipe 21 causes the release of pressure in the central channel 10 and thus avoids damage to the main part of inner pipe 21.

When the drilling pipe 8 with inner pipe 21 is withdrawn, the drilling tool 12 as well as the anchor cables remain in place and become rigidly attached to the bulb 7 while it hardens.

To this end the inclined terminal nozzle 16 projects a jet against the drilling tool 12 so that the tool is pushed toward the bottom of the drilling hole while the injection tool 9 is withdrawn, thus separating the drilling tool from the injection tool. Being inclined relative to the central channel 10, the terminal nozzle also helps to ensure a very good filling of the drilling hole with the injected cement, so that the anchor cables are completely immersed into the grout body. The drilling tool attached to the ends of the anchor cables additionally helps to improve their anchorage.

When the grout body has been formed over the desired length, the injection tool is withdrawn from the drilling hole.

As mentioned earlier, the present invention allows the procedure of placing grout anchors to be shortened and simplified in all applications while furnishing in all types of ground an anchorage that is reliable, well controlled and highly resistant.

I claim:

1. A process for forming grout anchors comprising the steps of:

drilling a hole in the ground by means of a device comprising a drilling pipe equipped at its front end with an injection tool coupled in an axially separable manner to a drilling tool attached to one or several anchor cables or other anchoring reinforcements, said pipe having a cement injection channel and said injection tool comprising at least two injection nozzles directed radially outwards and at least one injection nozzle directed inwardly towards the anchor cables or other anchoring reinforcements; and withdrawing and rotating the pipe while simultaneously injecting said cement slurry through said at least two injection nozzles directed radially outwards into the surrounding ground and through said at least one injection nozzle directed inwardly around the anchoring reinforcements and drilling tool to form an anchor bulb without mechanical reaming.

2. Process for forming grout anchors according to claim 1, wherein the cement slurry is injected at a pressure between 500 and 800 bars.

3. Process according to claim 1, wherein said cement injection channel is provided between an inner pipe coaxial with said drilling pipe and said drilling pipe, the inner pipe forming a central channel within which the cable and/or other anchoring reinforcements extend.

4. Process according to claim 3, wherein the device comprises a mechanical safety release part equipped with a portion of drilling pipe and portion of inner pipe coaxial with the drilling pipe portion whereby the inner pipe portion of the safety release part has a mechanical buckling resistance that is lower than the buckling resistance of the inner pipe.

5. Process according to claim 4, wherein the mechanical safety release part (22) is located close to an injection head (23) of the device.

* * * * *